US006123195A

United States Patent [19]

Kyle

[11] Patent Number: 6,123,195

[45] Date of Patent: Sep. 26, 2000

[54] PACKAGING SYSTEM, METHOD AND COMPONENTS USED THEREIN

[76] Inventor: Kenneth E. Kyle, 50 Old Fort Rd., Madison, Conn. 06443

[21] Appl. No.: 09/035,803

[22] Filed: Mar. 6, 1998

[51] Int. Cl.[7] ..... B65D 73/00

[52] U.S. Cl. ..... 206/478; 206/482

[58] Field of Search ..... 206/521, 583, 206/476, 477, 478, 480, 482, 495, 784; 211/70.1

[56] References Cited

U.S. PATENT DOCUMENTS

| | | | |
|---|---|---|---|
| 381,769 | 4/1888 | Folsom | 206/478 |
| 1,670,204 | 5/1928 | Moore | 206/482 |
| 1,803,602 | 5/1931 | Dey | 206/482 |
| 2,387,639 | 10/1945 | Bouchelle | 206/482 |
| 2,899,078 | 8/1959 | Magnus | 211/70.1 |
| 3,464,545 | 9/1969 | Bailey | 206/478 |
| 3,822,783 | 7/1974 | Mortensen | 206/480 |
| 4,865,097 | 9/1989 | Allen | 206/478 |

*Primary Examiner*—Paul T. Sewell
*Assistant Examiner*—Luan K. Bui
*Attorney, Agent, or Firm*—Robert H. Montgomery

[57] ABSTRACT

A system of securing an article in a container for shipping comprising at least two anchor clips extending into the container through the bottom, a wall thereof or a corner and defining an eye or aperture through which strapping is passed. The strapping is secured at its free ends by a friction buckle or other securing device and extends about the article to be shipped to secure the article at a given location within the container. The clips have a base which engages, essentially flush, an outside surface, outside wall or outside corner of the container and an upstanding leg which extends through the bottom, wall or corner of the container. The eye or aperture through which the strapping passes is defined in the legs extending into the interior of the container.

13 Claims, 2 Drawing Sheets

PACKAGING SYSTEM, METHOD AND COMPONENTS USED THEREIN

FIELD OF THE INVENTION

This invention relates to packaging systems, a method of packaging and components thereof.

BACKGROUND OF THE INVENTION

Articles of all kinds are commonly shipped in what is referred to as boxboard or paper board boxes of a size selected in accordance with the size of an article to be shipped.

Cardboard and paper boxes are generally made in standard sizes and sold to a shipper, either manufacturer or merchandiser, in unassembled flat form for ease of storage. In some instances a high volume shipper may have boxes of a specified size made. These will also be in unassembled flat form for ease of storage.

When needed, the boxes are assembled for shipping, the desired articles are packed therein with a selected filler and forwarded to a recipient.

To render the articles immobile or immovable in the container a filler of some type, commonly referred to as dunnage is packed about the article in the container. Paper or shredded paper has been used as a packing in the past to fill voids in the box around the article in the box. The use of small expanded plastic elements, often referred to as "peanuts" is in widespread usage, but is expensive. Such peanuts may be ineffective for very heavy items in that they may not restrain movement of heavy objects. Additionally, they are environmentally difficult to dispose of. In some case, such packing has been used where a plurality of small items either boxed or not boxed are shipped in a larger box.

Such packing or fillers, while usually effective for the intended purpose are a nuisance to both the shipper and the recipient. The shipper must maintain a large inventory of packing material which necessarily requires much space. The recipient of the article has the task of disposing of the filler as well as the box. It is not uncommon that the box is disposed of as trash with the filler therein. If there was no filler, the box could be knocked down and more easily disposed of.

In some cases, a manufacturer or merchandiser may use molded pieces of lightweight plastic having exterior dimensions complementary to the interior dimensions of the shipping box. Such molded pieces define an interior cavity shaped in accordance with articles to be shipped. This method of shipping is usally used in conjunction with higher priced articles of high volume. The molding or creation of such packing pieces places an additional cost burden on the manufacture or merchandiser and the molded packing pieces must define a customized cavity for each different article.

In many cases a manufacturer or merchandiser may wish to ship an article which is not amenable to conventional packing or filling and/or whose volume does not justify the cost of the molded cavity defining pieces for packaging, yet still wants to to secure and render the article in a standard size box.

The present invention provides a new and improved packaging system, method and components used therein for securing articles to be shipped within a standard shipping box without having to use dunnage or only a small amount of dunnage materials depending on the shipper's specifications.

An object of this invention is to provide a new and improved system and components therefor for securing an article in a box without having to utilize a loose packing material or molded inserts.

Another object of this invention is to provide a new and improved method and inexpensive components used therein which are adaptable to secure almost any type of object in a selected size box without requiring dunnage.

A further object of this invention is to provide a new and improved strap and anchor technique in securing articles in boxes for shipping.

A still further object of this invention is to provide a new and improved securing system using anchoring clips which serve as attachment points for interior strapping, cordage or wire which will restrain the object to be shipped in the container.

SUMMARY OF THE INVENTION

Briefly stated, the invention, in one form thereof, comprises anchor clips extending into a container through the bottom or a wall thereof, usually the bottom or even a corner thereof and defining an eye through which strapping is passed. The strapping is secured at its free ends by a joining device such as a friction buckle or compressible clamp and extends about the article to be shipped to secure it at a given location within the container. The anchor clips have a base which engages an outside surface, or surfaces in the case of a corner clip, and an upstanding leg which extends through a slit in the container. The leg has the eye defined therein to receive the strapping.

The features of the invention which are believed to be novel are particularly pointed out and distinctly claimed in the concluding portion of this specification. The invention, however, together with further objects and advantages thereof, may best be appreciated by reference to the following detailed description taken in conjunction with the drawings.

DETAILED DESCRIPTION OF THE DRAWINGS

FIG. 1 is a plan view of a boxboard container with its top flaps removed showing a T-shaped article secured therein in accordance with the invention;

FIGS. 2 and 2*a* are elevation views of an anchor clip utilized in practice of the invention;

Figure 8:
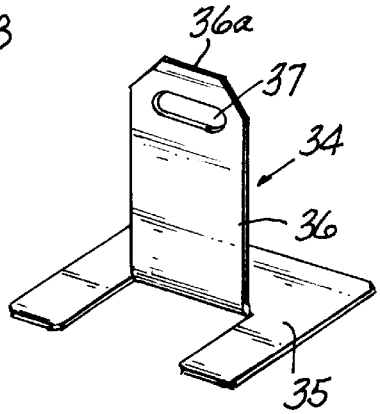
Figure 5A:
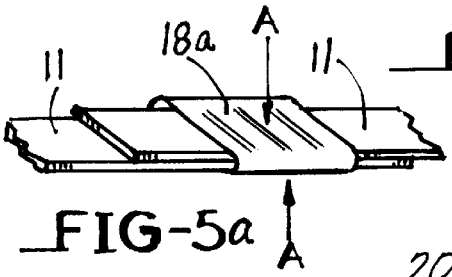
FIG. 5 is a sectional view of the buckle of FIG. 4 with strapping connected thereto seen in the plane of lines 5—5 of FIG. 1.
Figure 7:
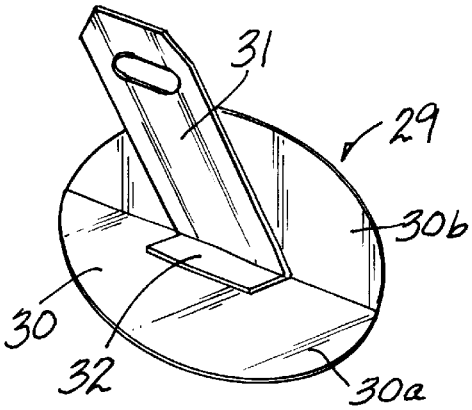
Figure 6:
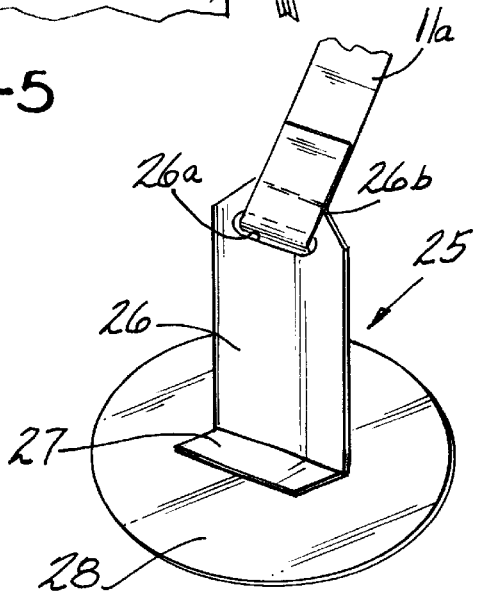

FIG. 5*a* is a perspective view of the ends of strapping joined by a crimped seal;

FIG. 6 is a perspective view of another anchor clip;

FIG. 7 is a perspective view of an anchor clip for placement at the corner of a container; and FIG. 8 is a perspective view of of another anchor clip which may used in the invention.

DESCRIPTION OF PREFERRED EMBODIMENTS OF INVENTION

Figure 1:
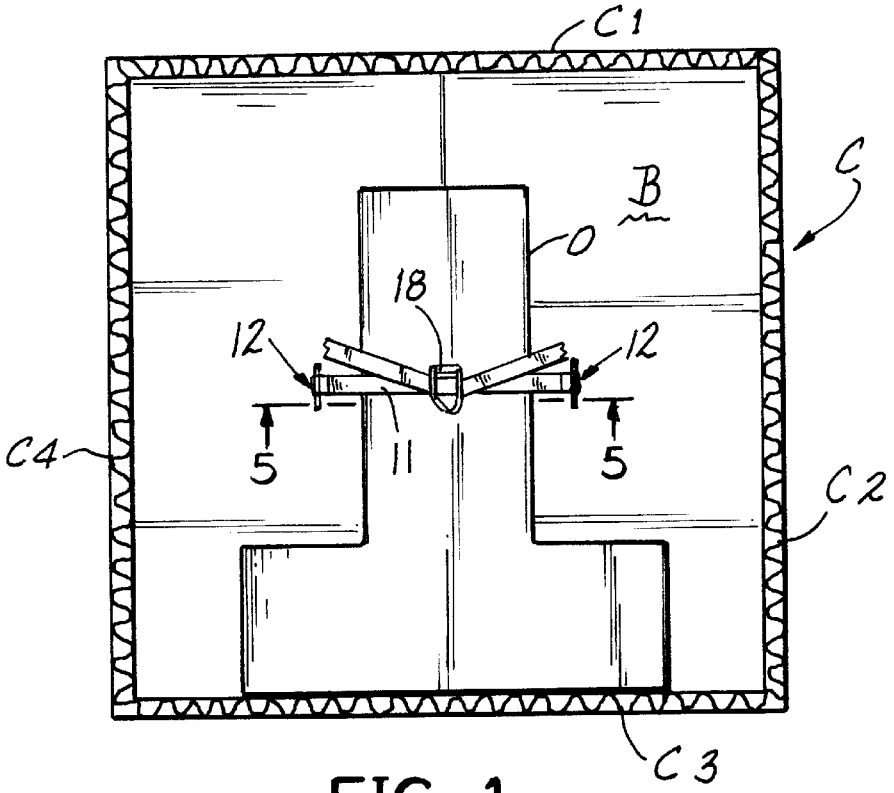

A container C of rectangular parallelepiped geometric shape is shown in FIG. 1, in plan view, with its top flaps removed. Container C has side panels C1–C4 and a bottom panel B defined by the usual fold over flaps. Container C is of a common construction of boxboard comprising a corrugated interior covered with linerboard on either side.

Within container C is an object O shown as T-shaped. Object O is secured in Container C by a strap 11 which is attached to container C by means of two anchor clips 12. The free ends of strap 11 are joined by a fastening device such as a friction buckle 18 shown in block form and hereinafter more fully illustrated and described.

Figure 2:
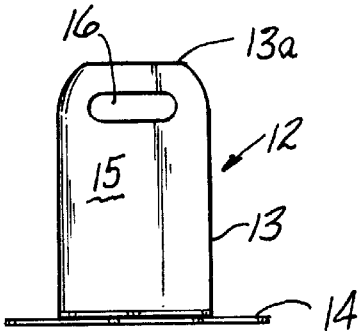
Figure 2A:
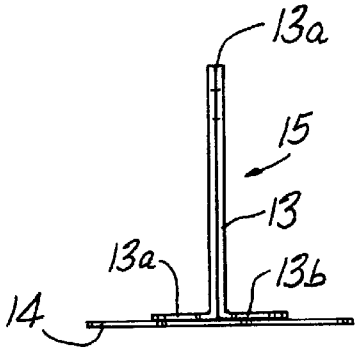

An anchor clip 12 is shown in FIGS. 2 and 2*a*. An anchor clip 12 comprises a base 14 of circular configuration, and an upstanding leg 15 having an aperture or generally rectangular eye 16 defined therethrough adjacent the free end 13*a* of leg 13. Eye 16 receives strap 11 therethrough to anchor strap 11 to bottom B. Legs 13 of anchor clips 12 extend through bottom B, usually two bottom flaps, through slits, (not shown) but hereinafter discussed, defined in bottom B.

The bases 14 of anchor clips 12 will be essentially flush with the outside surface of bottom B with the legs extending through the defined slits. The bases 14, being flush with the outside surface of a wall of the container, react forces exerted on the legs 13 by the tension in the strapping 11 when the ends of the strapping are joined. The slits may be defined to the exact width of legs with a knife 17 having a symmetrical triangular shaped blade 17*a* fitted to a handle 17*b* shown in FIG. 3. The blade 17*a* of knife 17 at its base is generally of the same dimension as the leg of an anchor clip and of substantially the same thickness as the leg. Shoulders 17*c* and 17*d* of handle 17*b* will limit the depth of insertion of blade 17*a* into a container when making a slit for a leg 15.

The bases 14 of the anchor clips 12 may be covered with a tape if deemed necessary, for example, standard two inch wide packaging tape. However, as previously pointed out the bases of the anchor clips are essentially flush with a wall(s) of a container and such covering is not deemed necessary unless the Postal authorities and/or the shipper or carrier make such requirement.

Figure 3:
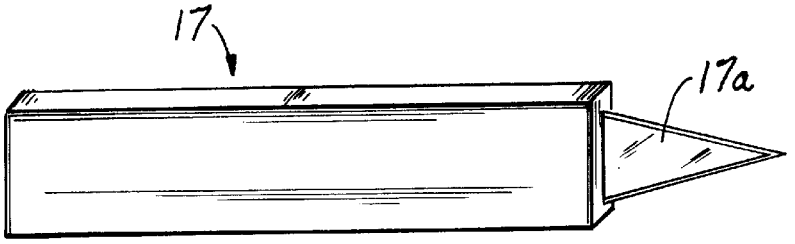
FIG. 3 is a view of a cutting and puncturing tool useful in practice of the invention.

The base 14 of a clip 12 as shown in FIGS. 2 and 2*a* has been made one an one-eighth inches in diameter so as to be completely covered by the aforementioned packaging tape. The leg 15 is made about three-quarters of an inch wide to provide for and eye 16 which will receive the standard one-half strapping 11. Leg 15 is made about one and one-half inches long to allow it to be inserted through a slit defined by a knife as shown in FIG. 3, and the eye readily accessible from the interior of the container.

Figure 4:
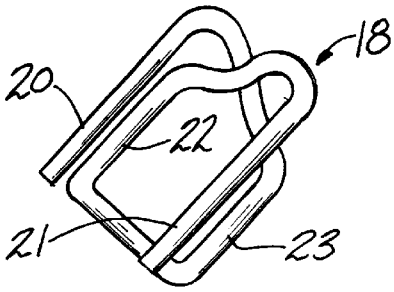
FIG. 4 is a perspective view of a strapping buckle which may be used in practice of the invention.
Figure 5:
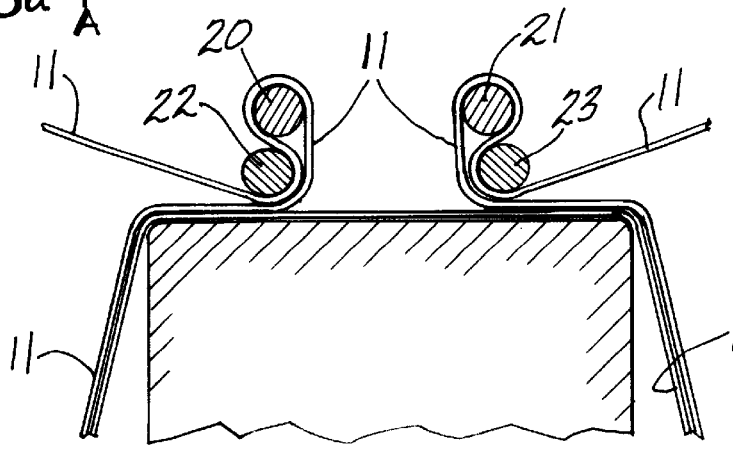

One type of fastening device for the free ends of strap 11 is a buckle 18 for frictional engagement of strapping 11 as shown in FIG. 4. This buckle 18 is formed of heavy wire stock defining essentially parallel arms 20–23 and provides frictional engagement of the strapping 11 as the strapping 11 is wound about the arms 20–23 of the buckle, as shown in FIG. 5. Kits including the strapping 11 and buckles 18 are available from International Plastics, Inc. of 185 Commerce Center, Greenville, S.C., among others. Instead of the buckle 18, a crimped metal seal may be used to secure the free ends of strap 11 together. Such seals and crimping tools therefor are available from the same source, as well as other sources. FIG. 5*a* shows the ends of strap(s) 11 joined by a crimped metal seal 18*a*. The strapping 11 is preferably of polypropylene or polyester. However other types of strapping or securing materials may be used. As used herein "strapping" includes cordage and wire. The fastener 13 will be selected in accordance with the type of strapping used.

Another anchor clip 25 is shown in perspective in FIG. 6. A leg 26 is formed with a bottom flange 27 which is affixed to a base 28 as by spot welding, solder brazing or any other suitable bond. The anchor clips may also be molded of a suitable plastic. The dimensions of the clip are substantially as previously stated.

FIG. 6 also exemplifies another embodiment of the invention where strapping 11*a* is passed through the eye 26*a* adjacent the free end 26*b* of leg 26 and secured to itself by any suitable means such as stapling, adhesive or heat bonding. In this embodiment an anchor clip 25 may be prepared with strapping attached thereto and eliminate the assembly step of threading a strap through the eyes of the anchor clips. The leg of an anchor clip may be inserted into a container as previously described and the strap 11*a* then pulled through the defined slit.

An anchor clip 29 designed to be inserted through a corner of a container is shown in FIG. 7. The base 30 of clip 29 is bent at a ninety degree angle. The leg 31 has a lower flange 32, bent at forty-five degrees which is attached to base 30 as previously described. Leg 31 bisects the ninety degree angle formed between the two defined sections 30*a* and 30*b* of base 30.

FIG. 8 shows another anchor clip 34 which is formed in one piece. Anchor clip 34 has a base 35 and an upstanding leg 36 having an eye 37 defined therein adjacent the free end 36*a* of leg 36. Anchor clips 34 may be formed by repeatedly stamping a moving strip of material to define the side edges of leg 36, free end 36*a* and eye 37. Then leg 36 is bent upwardly to fully define the anchor clip. The leg 36 may be dimensioned as previously stated and the overall rectangular dimensions of base 35 of about one and three-eighth inch on each side.

The corners of the free ends of the legs of all anchor clips are tapered or cut on a bias to facilitate insertion into and through the defined slits. The legs of all anchor clips may be made the full diameter of the base (except FIG. 8). However, the legs need only be wide enough to define an aperture or eye for the strapping used.

The anchor clips may be formed by a variety of techniques. For example they may be molded of plastic. The eyelet in a leg for a strap may be punched or otherwise defined in the leg at any point in a production line. In such manufacturing techniques the bases may be rectangular or circular.

When made of metal, the base and leg is preferably 0.020–0.025 inch thick and 0.040–0.045 when molded of plastic.

The invention provides an economical and simple system and method of securing an article in a container of standard size without the use of dunnage or a substantially reduced amount of dunnage.

It may thus be seen that the invention efficiently attains the objects of the invention set forth above as well as those made apparent. While preferred embodiments of the invention have been set forth for purposes of disclosure, other embodiments as well as modifications to the disclosed embodiments may occur to others. Accordingly, the appended claims are intended to cover all embodiments of the invention as well as the disclosed embodiments which do not depart from the spirit and scope of the invention.

What is claimed is:

1. A system for securing an object within a container which comprises at least two anchor clips, each of said anchor clips having a base and an upstanding leg with an aperture defined therein adjacent the free end of each of said legs, said base extending beyond said legs on either side thereof, said legs extending through slits in a wall of the container into the interior thereof, a strap extending through said apertures of said legs arranged to extend about an article in the container, said strap having free ends and said free ends being joined to tension said strap about the article in the container, said bases reacting the forces exerted on said legs by said strap against the wall of the container.

2. The system of claim 1 wherein each of said clips has a strap secured thereto and the free ends of said straps are secured together.

3. The system of claim 1 wherein the free ends of said strap are joined by a fastening device and said fastening device is a friction buckle.

4. The system of claim 1 wherein the free ends of said strap are joined by a fastening device and said fastening device is a compression clamp.

5. The system of claim 1 wherein the corners of the free ends of said legs are tapered to facilitate insertion of said legs through the defined slits.

6. A system of securing an object in a container which comprises at least two anchor clips, said anchor clips having a base and an upstanding leg, said legs extending through slits in the container into the interior thereof, a strap having a first end attached to each of said legs, said straps arranged to extend about an article in the container, said attached straps having second free ends and said free ends being joined to tension said straps about the article in the container.

7. The system of claim 6 wherein apertures are defined in said legs and said first ends of said straps are secured in said apertures.

8. The system of claim 6 wherein said first ends of said straps are joined to their respective straps after passing through said apertures.

9. The system of claim 8 wherein said free ends of said straps are joined by a friction buckle.

10. The system of claim 8 wherein said free ends of said straps are joined by a compression clamp.

11. A system for securing an object on to a panel member which comprises at least two anchor clips, each of said anchor clips having a base and an upstanding leg with an aperture defined therein adjacent the free end of each of said legs, said base extending beyond both sides of said leg, said legs extending through slits in the panel member, strapping extending through said apertures of said legs arranged to extend about an article on the panel member, said strapping having free ends and said free ends being joined to tension said strap about the article on the panel member, said base portions reacting the forces of said straps on said legs against said panel member.

12. The system of claim 11 where said strapping is a continuous strap passing through said apertures.

13. The system of claim 11 wherein said strapping comprises straps joined to each of said legs.

* * * * *